US007497068B2

(12) United States Patent
Nasiatka et al.

(10) Patent No.: US 7,497,068 B2
(45) Date of Patent: Mar. 3, 2009

(54) TWO-PIECE STRAPPING TOOL

(75) Inventors: Jason R. Nasiatka, Northbrook, IL (US); Janusz Figiel, Mundelein, IL (US); David E. Crittenden, Schaumburg, IL (US); Joseph E. Fabin, Elmwood Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/775,476

(22) Filed: Jul. 10, 2007

(65) Prior Publication Data

US 2009/0013656 A1 Jan. 15, 2009

(51) Int. Cl.
*B65B 11/00* (2006.01)
*B65B 13/24* (2006.01)

(52) U.S. Cl. ..... 53/582; 53/590; 100/33 PB

(58) Field of Classification Search ..... 53/582, 53/590, 592; 100/29, 32, 33 PB; 156/494, 156/502, 580
See application file for complete search history.

(56) References Cited

U.S. PATENT DOCUMENTS 2,982,069 A * 5/1961 England ..... 53/592
4,015,643 A * 4/1977 Cheung ..... 100/32
4,313,779 A 2/1982 Nix
4,871,414 A * 10/1989 Niedrig ..... 100/33 PB
4,934,261 A * 6/1990 Niedrig ..... 100/32
4,952,271 A * 8/1990 Cheung et al. ..... 100/33 PB
5,116,453 A * 5/1992 Niedrig ..... 100/33 PB
5,117,615 A * 6/1992 Kung et al. ..... 53/592
5,238,521 A * 8/1993 Cheung et al. ..... 100/33 PB
5,380,393 A 1/1995 Drabarek et al.
5,653,095 A * 8/1997 Stamm ..... 53/592
5,690,023 A * 11/1997 Stamm et al. ..... 100/33 PB
5,694,749 A 12/1997 Oseland
5,863,378 A * 1/1999 Panjwani et al. ..... 100/33 PB
6,109,325 A * 8/2000 Chang ..... 100/33 PB
6,338,375 B1 1/2002 Harada
6,533,013 B1 3/2003 Nix
6,564,701 B1 * 5/2003 Liu et al. ..... 100/33 PB
6,918,235 B2 7/2005 Nix
7,155,885 B1 1/2007 Nasiatka et al.

* cited by examiner

*Primary Examiner*—Louis K Huynh
(74) *Attorney, Agent, or Firm*—Mark W. Croll; Donald J. Breh; Levenfeld Pearlstein, LLC

(57) ABSTRACT

A two-piece strapping tool having a manual tensioner and a battery-operated sealer is disclosed. The tensioner is a feed-wheel tensioner that uses a serrated feedwheel to grip a first portion of the strap and a tension gripper to hold a second portion of the strap in a stationary position. The tensioner is configured to matingly receive the sealer between the tensioner's support legs such that the sealer may readily engage the overlapping portions of the strap to be welded. The sealer is battery-operated and uses a vibrational-type weld assembly driven by an electrical motor to weld overlapping portions of the strap. The sealer also includes a cutting assembly to sever the welded strap from a strap source.

18 Claims, 6 Drawing Sheets

TWO-PIECE STRAPPING TOOL

BACKGROUND OF THE INVENTION

The present invention pertains to a tool for tightening strap around an object or load and adhering the strap onto itself. More particularly, the present invention is directed to a two-piece strapping tool, comprising a manually-operated tensioner and a battery-operated sealer, that is configured to tension a strap around a load, weld or melt-adhere the strap onto itself and sever the strap from a strap source (e.g., supply).

Strapping tools (or "strappers") are well-known in the art. These tools come in a wide variety of types, from fully manual tools to automatic, table-top tools. Such tools generally are designed for use with either metal strapping or plastic/polymeric strap.

Strappers for applying plastic or polymeric strapping materials can be of the automatic, table-top type or portable, hand-held type and can be either electrically or pneumatically driven. This is necessary in order to provide energy for tensioning the strapping material and adhering the strap onto itself. Typically, the adhering function is provided by melting or otherwise welding a section of the polymeric (plastic) strapping material onto itself. Such melting or welding operations are generally carried out using ultrasonic or vibrational-type weld assemblies. The movement or vibrational motion can be provided by electrical, electromechanical or fluid drive (hydraulic or pneumatic) systems.

The prior art has developed several types of portable strappers. In one such exemplary prior art strapper, a pneumatic system is used to drive the motors to tension the strap (driving a tensioning wheel), and to move a vibrating element that is in contact with interfacial surfaces of overlapping plastic strap portions. The tool includes a pneumatic circuit to route the compressed gas (air) to the appropriate functional elements (clamps and motors) through valves and the like. In such a tool, the various functional elements are large and as such can be cumbersome. In addition, many such tools use one or more large (and heavy) mechanical clutch(es) to hold or clamp the strap following tension.

Thus, the prior art has developed smaller, more compact and more lightweight hand-held strappers, also known as "combination tools" because such tools combine the functions of tensioning, welding and cutting the strap into a single, one-piece hand-held device. Once such prior art strapper is battery-powered device that incorporates an electromechanical tensioning mechanism along with an electromechanical welding mechanism. In one embodiment, the strapper operates by using battery-powered electric motor to tension the strap around the load in a first stage, then using a second battery-powered electric motor to frictionally weld the strap to itself in a second stage. In another embodiment, a single electric motor may be used to drive both the tensioning and welding stages.

While the design of such one-piece, hand-held, battery-powered strappers is a significant improvement over the prior art, the prior art has not addressed the additional advantages that may achieved by separating the tensioning and welding functions into separate, independent components, with the tensioning component being manually-operated and the welding component being battery-operated. Separating the tensioning and welding functions into two separate components, while seemingly inconsistent with the prior art trend to consolidate strapper functionality into smaller and more compact one-piece devices, provides several significant advantages.

For example, the weight of each of the two individual components is less than the weight of a prior art one-piece strapper tool. Thus, the two-piece system is lighter, less cumbersome and easier to manipulate. Additionally, by making the tensioning function a manual operation, the battery life of the welding component is advantageously extended since no battery power is used in the tensioning operation. Finally, by making the tensioning function a manual operation, a higher strap tension is desirably achievable because the tensioning power of battery-operated strappers is limited by the battery strength and the size and strength of the motor driving the tensioning function.

Accordingly, there exists a need for a hand-held strapping tool that separates the tensioning function and the welding function into independent components. Desirably, the tensioning function is accomplished using a manually-operated tensioner that tensions a strap about a load and maintains the desired strap tension during the welding process. More desirably, the welding function is accomplished using a battery-operated sealer that uses a vibrational-type weld assembly to weld overlapping portions of the strap and a cutting assembly to cut the strap from the supply. Most desirably, the tensioner is configured to matingly receive the sealer, such that the sealer may be positioned between the tensioner support legs in order to readily engage the overlapping portions of the strap.

BRIEF SUMMARY OF THE INVENTION

The present invention comprises a two-piece strapping tool having a manually-operated tensioner and a battery-operated sealer.

In the preferred embodiment, the tensioner is a feedwheel tensioner that uses a serrated feedwheel to grip a first portion of the strap and a tension gripper to hold a second portion of the strap in a stationary position. The feedwheel rotates to draw up the slack in the strap to achieve the desired tension.

The tensioner holds the strap in a tensioned state until the overlapping portions of the strap are welded using the sealer. The tensioner is configured to matingly receive the sealer between the tensioner's support legs such that the sealer may readily engage the overlapping portions of the strap to be welded.

The sealer in the preferred embodiment is battery-operated and uses a vibrational-type weld assembly driven by an electrical motor to weld the overlapping portions of the strap. The sealer also includes a cutting assembly to sever the welded strap from a strap source.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
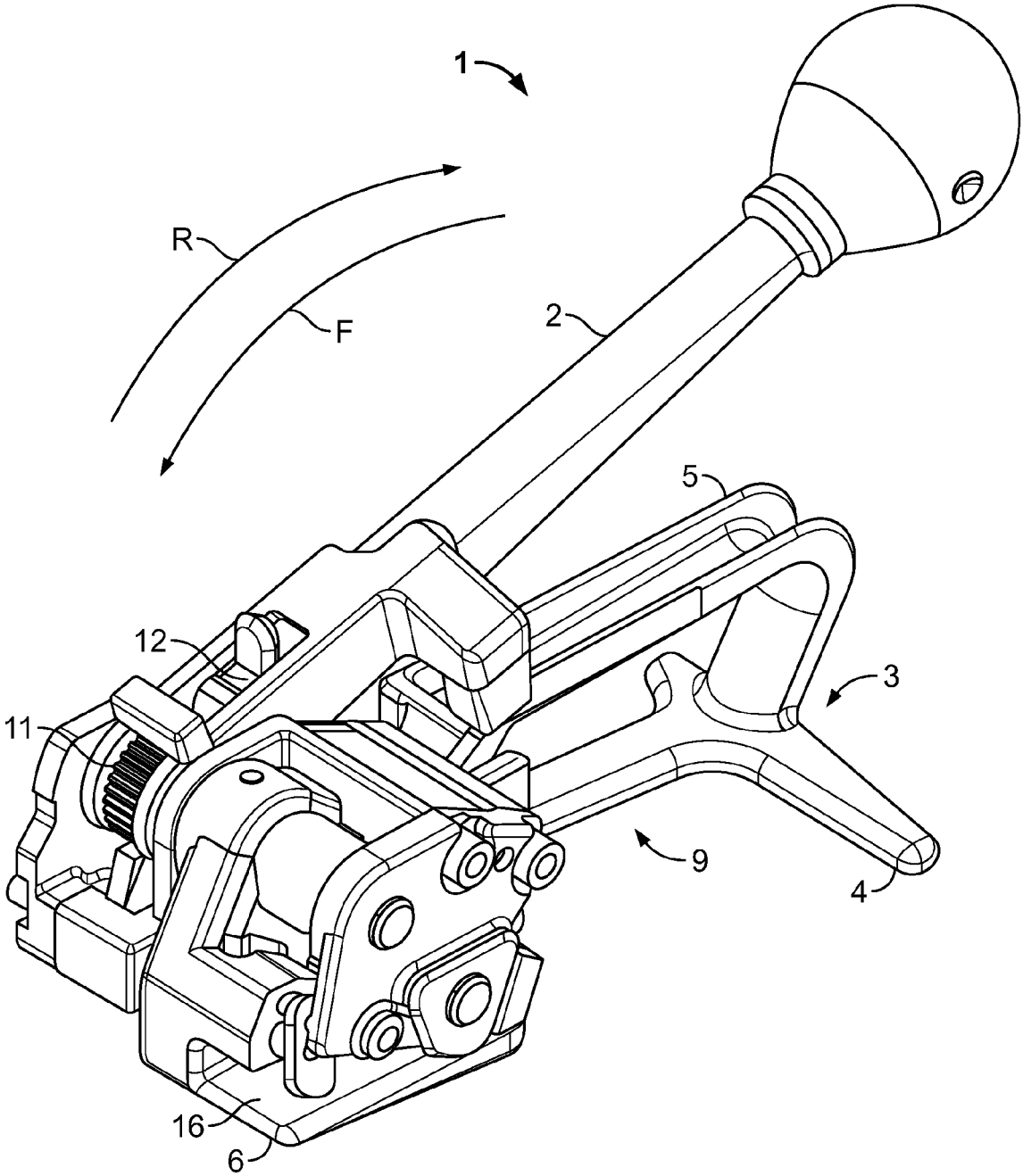
FIG. 1 is perspective view of the tensioner of the present invention.

While the present invention is susceptible of embodiment in various forms, there are shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent and Trademark Office, and does not imply, nor should be inferred to limit the subject matter disclosed herein.

The two-piece strapping system of the present invention comprises a manual tensioner and a battery-operated sealer. The tensioner is configured to receive and tension a strap about a load. The tensioner is further configured to matingly receive the sealer between the tensioner's support legs such that the sealer may readily engage the overlapping portions of the strap to be welded.

Figure 2:
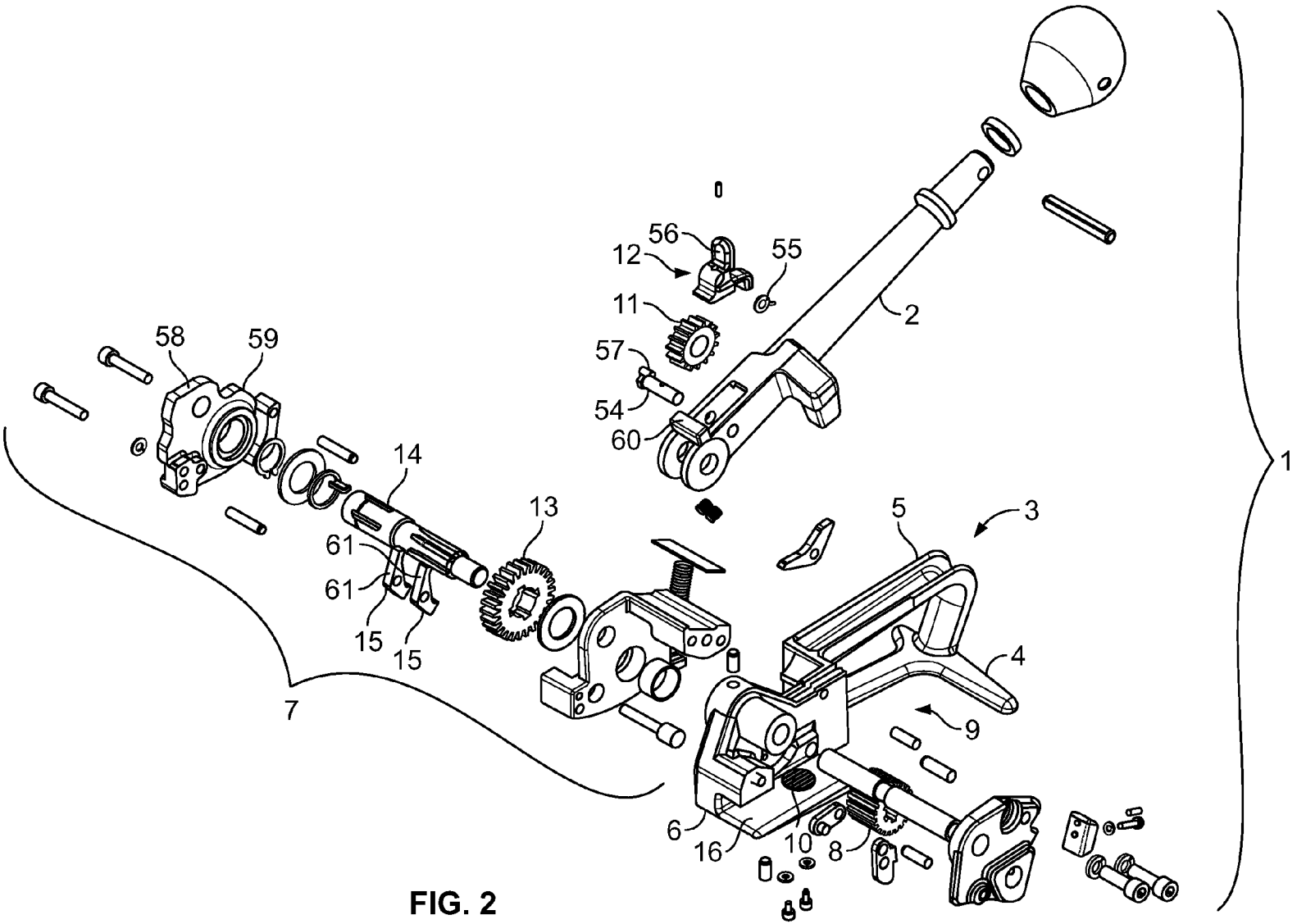
FIG. 2 is an exploded view of the tensioner of the present invention.

As shown in FIGS. 1 and 2, tensioner 1 is of the type generally known in the prior art. In the preferred embodiment tensioner 1 comprises a feedwheel tensioner, however other types of manual tensioners may be used without departing from the scope of the present disclosure.

Tensioner 1 comprises a handle 2 pivotally mounted to a frame 3. Frame 3 is an open structure comprises an integrated support leg 4, an integrated frame handle 5 and a base 6. Support leg 4 and base 6 have generally flat bottom surfaces to allow tensioner 1 to rest firmly against the load being strapped. Frame 3 is further configured such that the distance between support leg 4 and base 6 forms an opening 9 within which the sealer may be positioned into order to weld the strap, as discussed below.

Also mounted to frame 3 is a drive mechanism 7 and a serrated feedwheel 8. Drive mechanism 7 is configured to engage both handle 2 and serrated feedwheel 8 such that when handle 2 is rotated pivotally about frame 3, handle 2 drives serrated feedwheel 8 and causes it to rotate.

As is known in the art, handle 2 drives a pinion gear 11 in cooperation with drive pawl 12. Pinion gear 11 is rotatably mounted to handle 2 using a drive pawl pin 54. Drive pawl 12 engages pinion gear 11 in a ratchet-like fashion and drives pinion gear 11 when handle 2 is pivotally rotated in a rearward direction (in the direction of arrow R in FIG. 1). When handle 2 is pivotally rotated in a forward direction (in the direction of arrow F in FIG. 1), drive pawl 12 disengages from pinion gear 11 and does not drive pinion gear 11. In this matter, handle 2 can drive pinion gear only when handle 2 is pivotally rotated in a rearward direction (such as when handle 2 is used to apply tension to the strap as further discussed below). Drive pawl 12 is biased into engagement with pinion gear 11 with a drive pawl spring 55.

Drive pawl 12 further includes a means to disengage drive pawl 12 from pinion gear 11. In the preferred embodiment, drive pawl 12 includes a tab 56 extending upwardly from drive pawl 12. Tab 56 is configured to permit a user of tensioner 1 to manually disengage drive pawl 12 from pinion gear 11 by moving drive pawl 12 away from pinion gear 11. This permits handle 2 to be repositioned without rotating pinion gear 11.

Pinion gear 11 is configured to engage with a tension gear 13 such that tension gear 13 rotates upon rotation of pinion gear 11. Tension gear 13, in turn, is mounted upon a feedwheel shaft 14, such that as tension gear 13 drives feedwheel shaft 14 when tension gear 13 is rotated. Retaining pawls 15 are configured to engage feedwheel shaft 14 in a ratchet-like manner (much like how drive pawl 12 engages pinion gear 11) and to prevent feedwheel shaft 14 from rotating in a direction opposite from the direction feedwheel shaft 14 is driven by tension gear 13.

Feedwheel shaft 14 is configured to engage serrated feedwheel 8 such that feedwheel shaft 14 drives serrated feedwheel 8 when feedwheel shaft 14 is driven by tension gear 13 and pinion gear 11. As noted above, serrated feedwheel 8 is formed with surface deformations, serrations in the preferred embodiment, that are configured to securely engage an upper surface of the overlapping portions of the strap and urge the upper portion of the overlapping strap in a direction intended to cause the strap to tighten about the load.

Frame 3 further includes an integrated channel 16 through which overlapping portions of the strap pass in order to be engaged by tensioner 1. Channel 16 includes a tension gripper 10 mounted on the bottom surface of channel 16. Tension gripper 10 is configured to securely engage (or grip) the bottom surface of the overlapping portions of the strap and to maintain the lower portion of the overlapping strap in a generally stationary position relative to the upper portion of the overlapping strap. In this manner, the strap may be tightened about the load to achieve the desired tension.

The operation of tensioner 1 is well known to those skilled in the art. A strap is fed from a source (such as from a roll) around a load to be secured. The end of the strap is looped about the load and then overlapped on top of itself. Tensioner 1 is placed against the load and the overlapping portion of the strap is positioned within channel 16 such that serrated feedwheel 8 engages the upper surface of the upper portion of the overlapping strap, and tension gripper 10 engages the bottom surface of the bottom portion of the overlapping strap.

Handle 2 of tensioner 1 then is pivotally rotated in a forward and rearward direction (or cranked) about frame 3 of tensioner 1, while frame handle 5 is held to maintain tensioner 1 in a relatively fixed position against the load. As handle 2 of tensioner 1 is cranked, feedwheel 8 urges the upper portion of the overlapping strap in a direction that causes the strap to tighten about the load. Once the strap is tightened to a desired tension, tensioner 1 holds the strap in a tensioned state until the overlapping portions of the strap are welded using the sealer, as discussed below.

To release tensioner 1 from the tensioned and welded strap, handle 2 is rotated in a forward direction (in the direction of arrow F in FIG. 1) causing cam portion 57 of drive pawl pin 54 to ride against cam surface 58 of bearing plate 59. This causes drive pawl 12 to rotate out of engagement with pinion gear 11. Continued forward rotation of handle 2 urges bar 60 formed at the base of handle 2 into contact with the upper faces 61 of retaining pawls 15 and causes retaining pawls 15 to disengage from tension gear 13. This permits tension gear 13 to freely rotate and feedwheel 8 to disengage from the strap, allowing the tensioner 1 to be removed from the strap.

Figure 3:
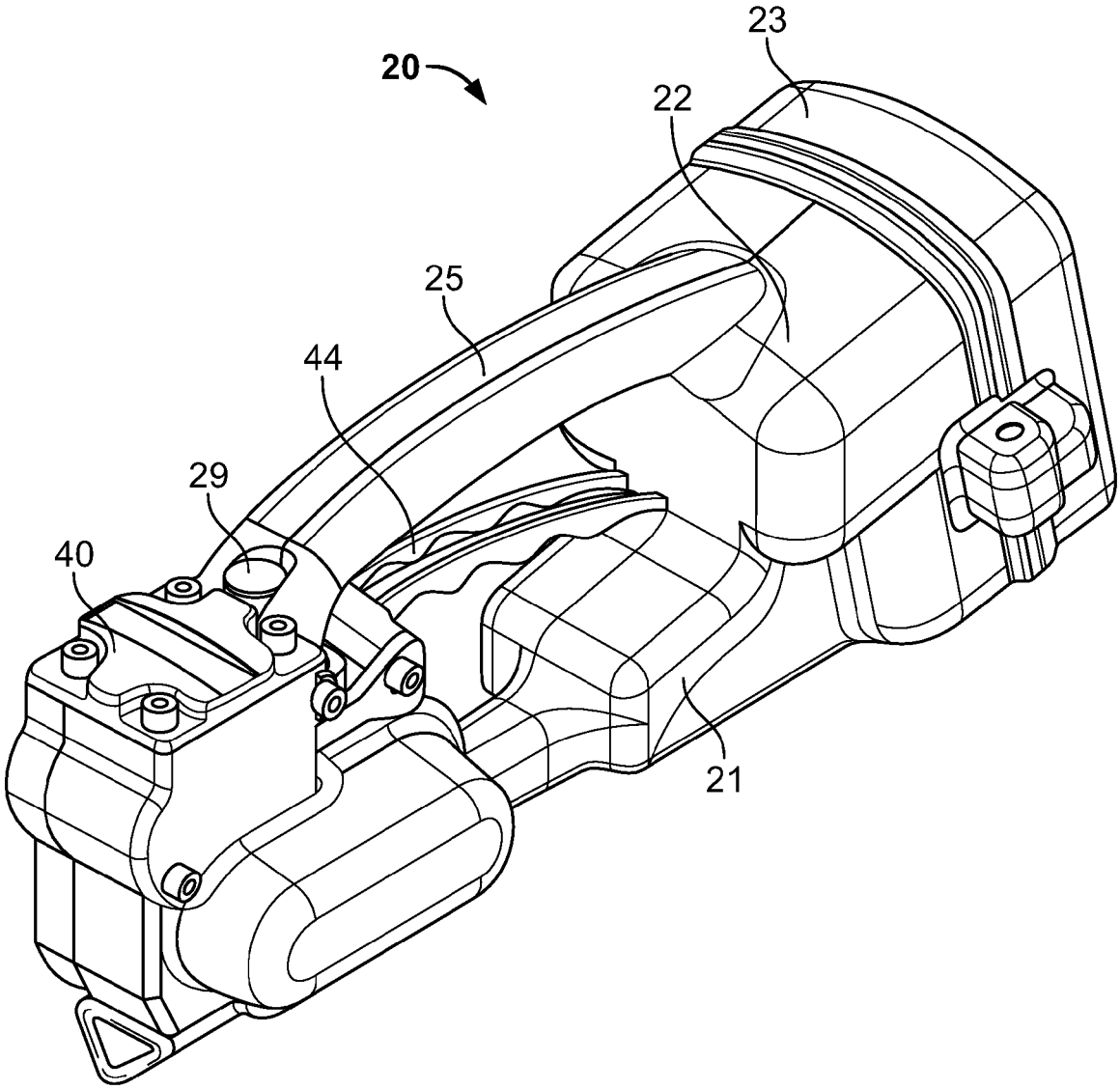
FIG. 3 is a perspective view of the sealer of the present invention.
Figure 4:
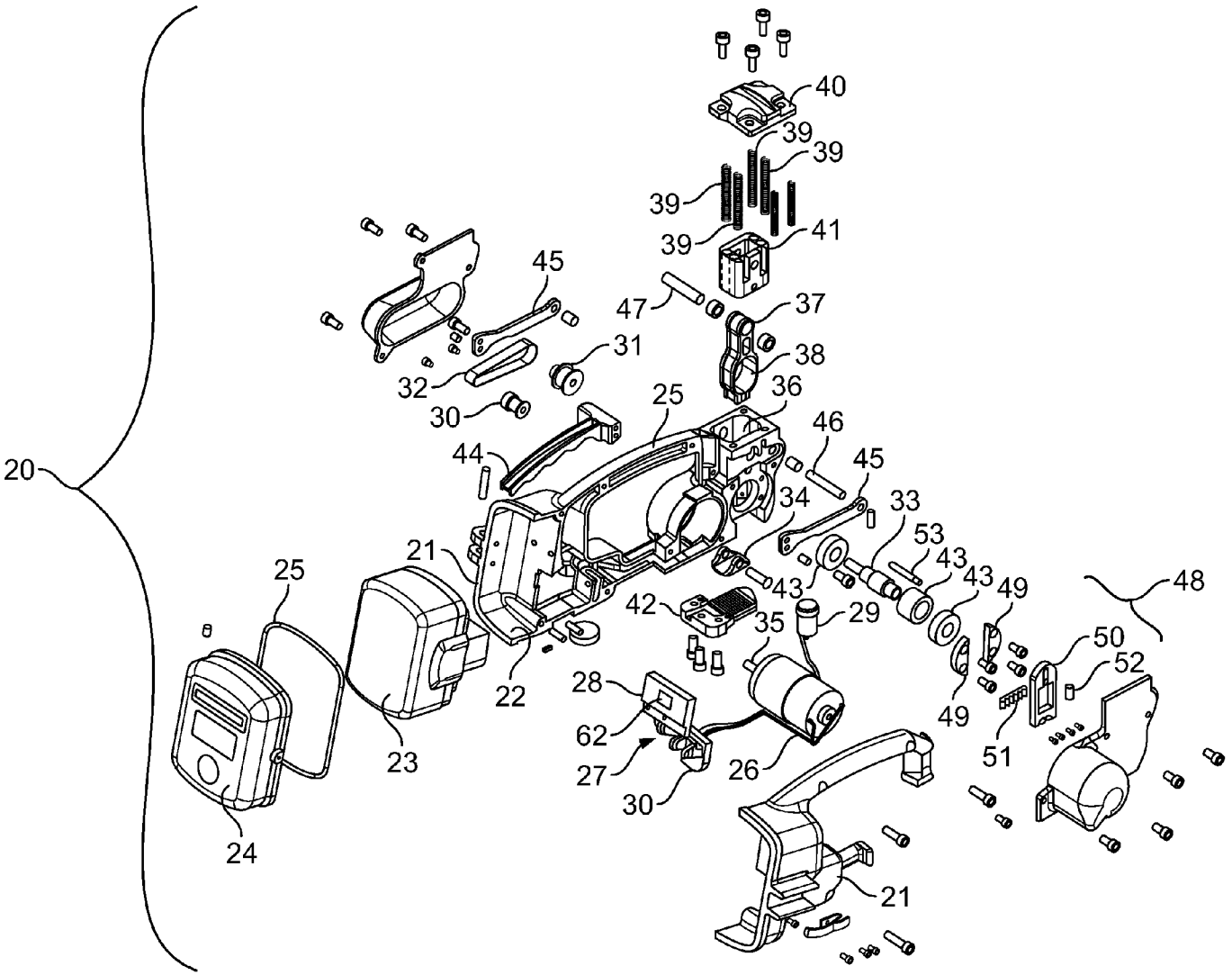
FIG. 4 is an exploded view of the sealer of the present invention.

As shown in FIGS. 3 and 4, sealer 20 is a battery-operated sealer that uses a vibrational-type weld assembly driven by an electrical motor. Sealer 20 is configured to accept overlapping portions of a tensioned strap (tensioned using tensioner 1 as described above) and to weld a portion of the overlapping strap in order to maintain the strap in a desired tensioned state about a load. Sealer 20 also preferably includes a cutting mechanism to sever the welded trap from the source.

In the preferred embodiment, sealer 20 is constructed as a one-piece unit having an outer housing 21. Preferably, housing 21 is sealed in a watertight manner to permit use of sealer 20 in inclement conditions.

Sealer 20 is configured at one end with a battery compartment 22 for holding a rechargeable battery 23 for portable tools as is known in the prior art. In the preferred embodiment, battery 23 is a 14.4V battery manufactured by Bosch, but any suitable battery may be used.

Preferably, battery compartment 22 includes a hinged access door 24 to allow for easy access to battery 23 for charging and/or replacing battery 23. A gasket 25 preferably is disposed between access door 24 and housing 21 to maintain the seal of housing 21.

Sealer 20 further comprises a handle 25 formed in housing 21 and configured to allow sealer 20 to be portable and easily transported and used in various orientations (e.g., horizontally and vertically).

Sealer 20 also includes a motor 26 mounted within housing 21. Motor 26 is an electric motor operatively connected to an electrical assembly 27. Electrical assembly 27 includes a circuit board 28 programmed to control the operation of motor 26 as well as connector 30 to interface with battery 23 and to allow battery 23 to power circuit board 28 and motor 26.

In the preferred embodiment, circuit board 28 is potted, such as with a cured epoxy, as is known in the art, to provide moisture resistance to the electrical components on circuit board 28. Additionally, in the preferred embodiment, circuit board 28 includes a low voltage cutoff device 62 as is known in the art. The low voltage cutoff device is configured to cutoff power to motor 26 when battery 23 does not have a sufficient voltage level to adequately power sealer 20.

Electrical assembly 27 further comprises a switch 29. Switch 29 in the preferred embodiment is a lighted push button switch as is known in the art. Switch 29 is disposed in housing 21 such that the lighted push button of switch 29 extends through housing 21 and is accessible to a user of sealer 20. Switch is coupled to circuit board 28 and motor 26 such that actuation of switch 29 activates motor 26.

Sealer 20 further comprises a vibrational-type weld assembly in the preferred embodiment. The general design and operation of the vibrational-type weld assembly of sealer 20 is known in the art.

In the preferred embodiment, an upper weld gripper 34 is vibrated by motor 26. To this end, motor 26 includes a shaft 35 on which is mounted a pulley 30 as illustrated in FIG. 4. A drive belt 32 is trained around pulley 30 and around another pulley 31 which is mounted to the lower end of an eccentric shaft 33. Eccentric shaft 33 is disposed within a cavity 36 that extends vertically through housing 21.

Disposed vertically within cavity 36 is a vibrator arm 37 pivotally mounted to a piston 41, also disposed vertically within cavity 36. Vibrator arm 37 includes a bore 38 through which eccentric shaft 33 passes. Eccentric shaft 33 further includes a plurality of bearings 43 mounted thereupon and configured to limit the movement of vibrator arm 37 in a generally reciprocating manner in a direction transverse to the longitudinal axes of the overlapping portions of the strap (that is, from the front of sealer 20 towards the rear of sealer 20). The use of an eccentric shaft and bearings to control movement of a vibrating member in known to those skilled in the art of vibrational-type weld assemblies used in strappers, and those skilled in the art will recognize that a number of alternate are various configurations and structures that can be used to achieve the same vibrational motion.

Piston 41 is biased downwardly in cavity 36 by a plurality of springs 39 disposed between piston 41 and a top cover 40 of housing 21. In the preferred embodiment of the present invention, top cover 40 is removable and springs 39 are replaceable such that different sized springs may be used to adjust the downward (normal) force exerted by the springs on piston 41 and, ultimately, on the strap during the welding process.

On the lower end of vibrator arm 37, an upper weld gripper 34 is pivotally mounted. Upper weld gripper 34 is configured to align with a base plate 42 mounted on the bottom of housing 21, with the overlapping portions of the strap disposed therebetween during the welding process.

In the preferred embodiment, upper weld gripper 34 and base plate 42 are formed with serrations configured to engage the overlapping portions of the strap during welding process. However, those skilled in the art will recognize that there are various additional configurations and structures that can be used to engage the strap during the welding process.

Sealer 20 further comprises a handle 44 mounted to a pair of lift arms 45 and disposed beneath handle 25. Lift arms 45 are pivotally mounted to housing 21 using a handle pin 46. Lift arms 45 are further configured to engage piston 41 through a piston pin 47 such that when handle 44 is raised upwardly (that is, towards handle 25), lift arms 45 force piston upward in cavity 36 (against the biasing force of springs 39). Consequently, piston 41 causes upper weld gripper 34 to rise upwardly, thereby increasing the gap between upper weld gripper 34 and base plate 42 and allowing overlapping portions of the strap to be loaded between upper weld gripper 34 and base 42.

Sealer 20 also comprises a cutting assembly 48 mounted to housing 21 adjacent to cavity 36. In the preferred embodiment, cutting assembly includes a pair of cutter guides 49 mounted to housing 21 and creating a channel therebetween within which a cutter insert holder 50 is slidably mounted such that cutter insert holder 50 can move in a vertical direction (that is, towards the top and bottom of sealer 20). A cutter insert 51 is mounted to the bottom of cutter insert holder 50 and is configured to engage the upper portion of the overlapping portions of the strap and to sever the upper A cutter pin 53 engages cutter insert holder 50 and operatively connects it to piston 41 such that piston 41 causes cutter insert holder 50 to rise upwardly (when handle 44 is raised upwardly), thereby raising cutter insert 51 and allowing overlapping portions of the strap to be loaded between upper weld gripper 34 and base 42. A spring 52 biases cutter insert holder 50 downward such that when handle 44 is released and piston 41 moves downwardly, cutter insert holder 50 also moves downwardly.

The operation of sealer 20 is known to those skilled in the art. Handle 44 is gripped and moved upwardly towards handle 45, thereby causing upper weld gripper 34 and cutter insert 51 to rise upwardly to expand the distance between upper weld gripper 34 and cutter insert 51, and base plate 42. Sealer 20 is positioned such that overlapping portions of a strap then are disposed between upper weld gripper 34 and base plate 42 and handle 44 is released, allowing upper weld gripper 34 and cutter insert 51 to move downwardly and to engage the upper portion of the overlapping strap while forcing the lower portion of the overlapping strap into engagement with base plate 42.

Switch 29 is then depressed, thereby activating motor 26 which causes vibrator arm 37 and upper weld gripper 34 (and the upper portion of the overlapping strap) to vibrate rapidly while base plate 42 (and the lower portion of the overlapping strap) remains stationary. The friction caused by the rapid vibration generates heat which in turn melts the overlapping portions of the strap and adheres (welds) them to one another.

At the same time, cutter insert 51 is in contact with the upper portion of the overlapping strap and cutter insert 51 cuts the upper portion of the overlapping strap to separate the strap from the source.

After the welding process is complete, handle 44 again is gripped and moved upwardly towards handle 45, thereby causing upper weld gripper 34 and cutter insert 51 to rise upwardly to expand the distance between upper weld gripper 34 and cutter insert 51, and base plate 42, allowing the welded strap to be disengaged from sealer 20.

Figure 5:
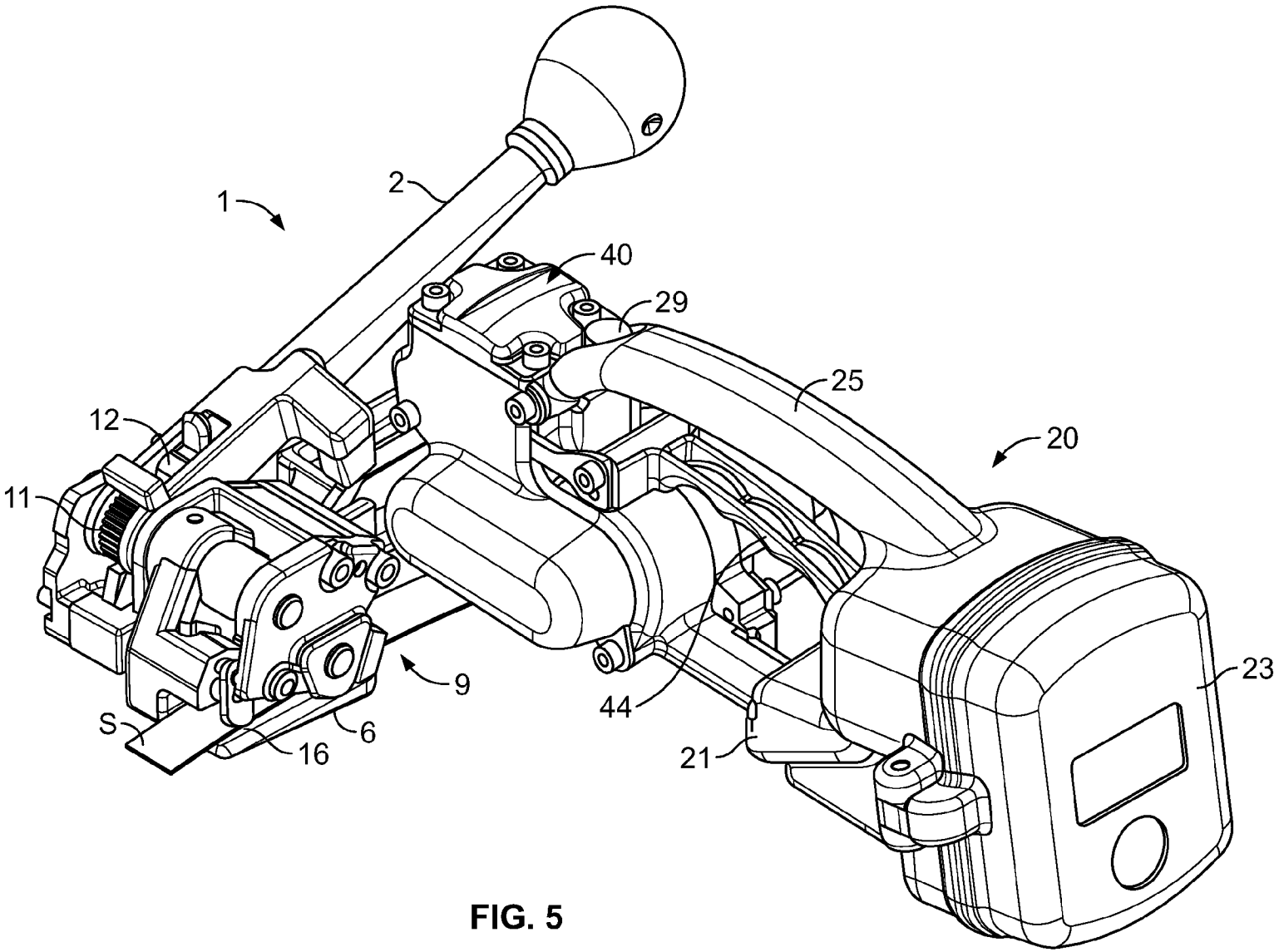
FIG. 5 is perspective view of the tensioner and sealer of the present invention positioned to weld a strap.
Figure 6:
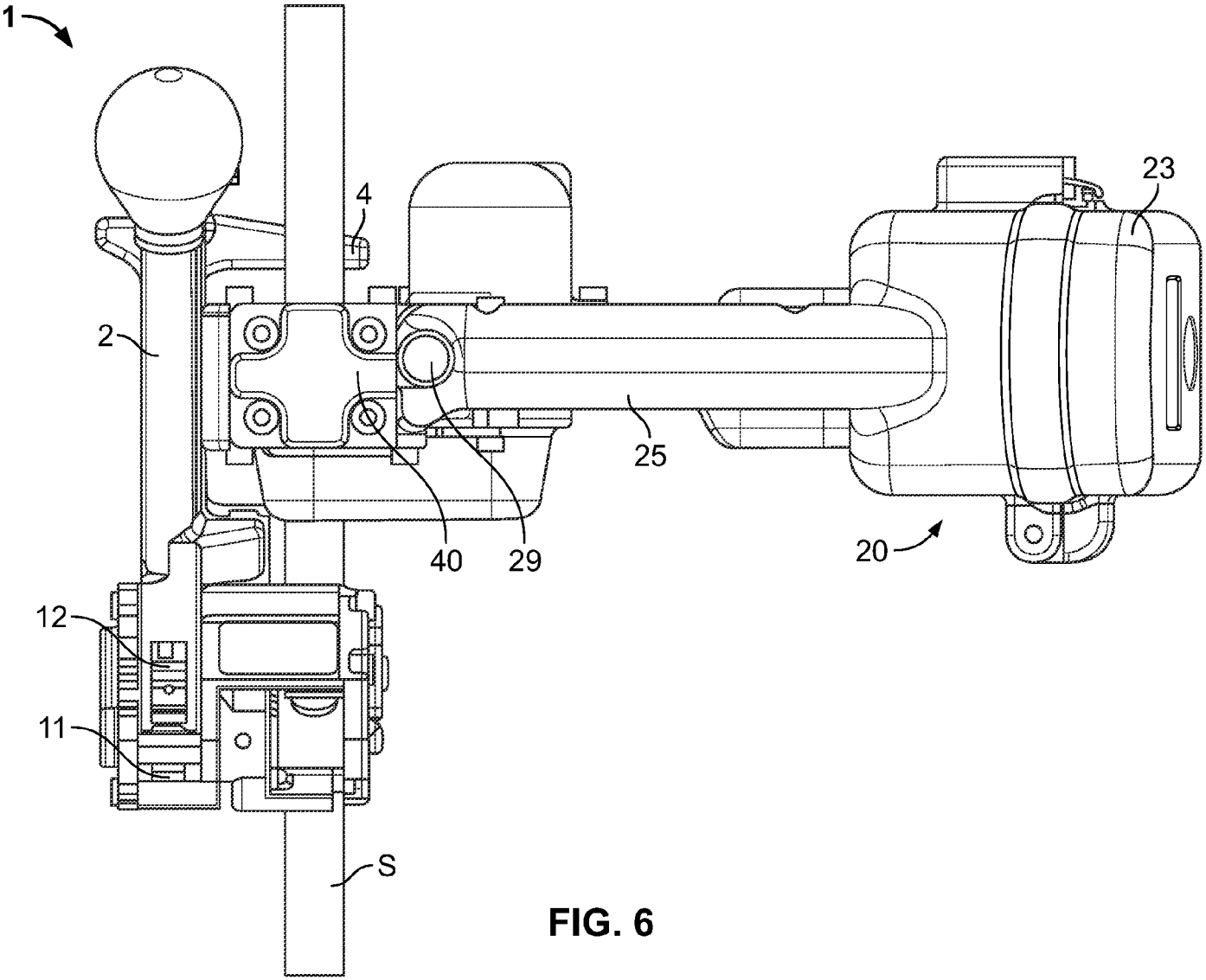
FIG. 6 is a top view of the tensioner and sealer of the present invention positioned to weld a strap.

As shown in FIGS. 5 and 6, the two-piece strapping tool of the present invention uses a combination of tensioner 1 and sealer 20 as described above. A strap S is fed from a source (not shown), such as a roll, and around a load (not shown) to be secured. The end of strap S is looped about the load and then overlapped on top of itself. Tensioner 1 is placed against the load and the overlapping portion of strap S is positioned within channel 16 such that serrated feedwheel 8 engages the upper surface of the upper portion of the overlapping strap, and tension gripper 10 engages the bottom surface of the bottom portion of the overlapping strap.

Handle 2 of tensioner 1 then is pivotally rotated (or cranked) about frame 3 of tensioner 1, while frame handle 5 is held to maintain tensioner 1 in a relatively fixed position against the load. As handle 2 of tensioner 1 is cranked, feedwheel 8 urges the upper portion of overlapping straps in a direction that causes the strap to tighten about the load. Once strap S is tightened to a desired tension, tensioner 1 holds strap S in a tensioned state.

Sealer 20 then is positioned in opening 9 formed between support leg 4 and base 6 of tensioner 1 and handle 44 is moved upwardly to cause upper weld gripper 34 and cutter insert 51 to rise and allow insertion of the overlapping portions of tensioned strap S between upper weld gripper 34 and base plate 42. Unlike prior art combination tools, sealer 20 is front loading and engages the overlapping portions of tensioned strap S from a direction transverse to the longitudinal axes of the overlapping portions of tensioned strap S.

Once the overlapping portions of strap S are properly aligned between upper weld gripper 34 and base plate 42, handle 44 is released and upper weld gripper 34 and cutter insert 51 move downwardly to engage the upper portion of the overlapping portions of tensioned strap S and to force the lower portion of the overlapping portions of tensioned strap S into engagement with base plate 42.

Switch 29 is then depressed, thereby activating motor 26 which causes vibrator arm 37 and upper weld gripper 34 (and the upper portion of overlapping portions of tensioned strap S) to vibrate rapidly while base plate 42 (and the lower portion of overlapping portions of tensioned strap S) remains stationary. The friction caused by the rapid vibration generates heat which in turn melts the upper portion and lower portion overlapping portions of tensioned strap S and adheres (welds) them to one another.

At the same time, cutter insert 51 is in contact with the upper portion of the overlapping portions of tensioned strap S and cutter insert 51 cuts the upper portion of the overlapping portions of tensioned strap S to separate strap S from the source.

After the welding process is complete, handle 44 again is gripped and moved upwardly towards handle 45, thereby causing upper weld gripper 34 and cutter insert 51 to rise upwardly to expand the distance between upper weld gripper 34 and cutter insert 51, and base plate 42, allowing the tensioned and welded strap S to be disengaged from sealer 20. Tensioner 1 then is released from tensioned and welded strap S in the manner previously described.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. A two piece strapping tool for tensioning a strap around a load, adhering the strap onto itself, and cutting a feed end of the strap, comprising:

a manual tensioner; and a powered sealer;

wherein the tensioner comprises a frame having a support leg, a base, and an opening defined by a distance between the support leg and the base, and wherein the tensioner is configured to matingly receive the sealer in the opening, and wherein the sealer comprises a housing having a cutting assembly mounted thereto, and wherein the sealer is configured to engage an overlapping portion of the strap, the overlapping portion of the strap having an upper portion and a lower portion, while at least a portion of the sealer is disposed in the opening of the tensioner, wherein the sealer comprises a vibrational-type weld assembly driven by a motor, the vibrational-type weld assembly including a piston disposed in a cavity formed in the housing, a vibrator arm disposed in the cavity and connected to the piston, an upper weld gripper mounted to the vibrator arm, a base plate mounted to the housing of the sealer and disposed in alignment with the upper weld gripper, and a handle operatively connected to the piston and configured to move the piston within the cavity;

wherein the upper weld gripper and the base plate are configured to accept and engage the overlapping portion of the strap therebetween, and the motor is operatively connected to the vibrator arm by an eccentric shaft, and the vibrator arm is configured to vibrate the upper weld gripper when the motor is activated.

2. The strapping tool of claim 1 wherein the vibrational-type weld assembly further comprises at least one spring disposed adjacent to the piston and configured to exert a biasing force against the piston.

3. The strapping tool of claim 2 wherein the at least one spring is replaceable with at least one substitute spring configured to exert a different biasing force against the piston.

4. The strapping tool of claim 1 wherein the motor is operatively connected to the vibrational-type weld assembly by a plurality of pulleys and a drive belt.

5. The strapping tool of claim 1 wherein the motor is controlled by an electrical assembly, wherein the electrical assembly comprises a circuit board programmed to control the motor.

6. The strapping tool of claim 5 wherein the circuit board is potted.

7. The strapping tool of claim 5 wherein the circuit board includes a low voltage cutoff device.

8. The strapping tool of claim 5 wherein the electrical assembly further comprises a lighted switch configured to control operation of the motor.

9. The strapping tool of claim 1 wherein the upper weld gripper and the base plate are formed with serrations configured to engage the overlapping portion of the strap.

10. The strapping tool of claim 1 wherein the cutting assembly comprises:

a plurality of cutter guides mounted to the housing and defining a channel;

a cutter insert holder disposed within the channel, the cutter insert holder configured to slidably move within the channel;

a cutter insert mounted on the cutter insert holder, the cutter insert configured to engage and sever the upper portion of the overlapping portion of the strap.

11. The strapping tool of claim 1 wherein the sealer is configured to weld the overlapping portion of the strap when a longitudinal axis of the housing is disposed transverse to a longitudinal axis of the overlapping portion of the strap.

12. A two-piece strapping tool for tensioning a strap around a load, adhering the strap onto itself, and cutting a feed end of the strap, comprising:

a powered sealer comprising a housing having a cutter assembly mounted thereon, wherein the sealer is configured to engage overlapping portion of the strap, the overlapping portion of the strap having an upper portion and a lower portion;

a manual feedwheel tensioner comprising a frame having a support leg, a base, and an opening defined by a distance between the support leg and the base, wherein the manual feedwheel tensioner is configured to matingly receive the powered sealer in the opening;

said manual feedwheel tensioner further comprising:

a handle pivotally mounted to the frame;

a drive mechanism mounted to the frame, the drive mechanism having a rotatable feedwheel configured to engage the upper portion of the overlapping portion of the strap and to cause the upper portion of the overlapping portion of the strap to move relative to the lower portion of the overlapping portion of the strap;

a channel formed in the frame and configured to accept the overlapping portion of the strap;

a tension gripper mounted on a bottom surface of the channel and aligned with the feedwheel and configured to engage the lower portion of the overlapping portion of the strap and to maintain the lower portion of the overlapping portion of the strap in a stationary position relative to the upper portion of the overlapping portion of the strap;

said drive mechanism further comprising:

a pinion gear rotatably mounted to the handle;

a drive pawl mounted to the handle and configured to engage the pinion gear;

a feedwheel shaft;

a tension gear mounted on the feedwheel shaft; and a least one retaining pawl mounted to the frame and configured to engage the feedwheel shaft;

wherein the handle is operatively connected to the drive mechanism whereby the handle drives the feedwheel and causes it to rotate, and wherein rotation of the feedwheel causes the strap to tighten around the load;

wherein the pinion gear is configured to engage the tension gear and cause the tension gear to rotate upon rotation of the pinion gear, and wherein the tension gear is configured to cause the feedwheel shaft to rotate upon rotation of the tension gear;

wherein the drive pawl drives the pinion gear in a direction; and wherein the at least one retaining pawl prevents the feedwheel shaft from rotating.

13. The strapping tool of claim 12 wherein the feedwheel comprises surface deformations.

14. The strapping tool of claim 13 wherein the surface deformations comprise serrations.

15. The strapping tool of claim 12 wherein the drive pawl further comprises a tab configured to permit the drive pawl to be disengaged from the pinion gear.

16. The strapping tool of claim 12 wherein the housing of the sealer further comprises a watertight enclosure.

17. The strapping tool of claim 12 wherein the sealer is powered by a battery.

18. The strapping tool of claim 17 wherein the housing of the sealer further comprises a hinged access door configured to allow access to the battery.

* * * * *